US006422180B1

(12) United States Patent
Yiu

(10) Patent No.: US 6,422,180 B1
(45) Date of Patent: Jul. 23, 2002

(54) FLUSH LINE FOR DISHWASHER

(76) Inventor: Chap-Chung Yiu, 14th Fl., No. 8, Alley 72, Lane 1, Sec. 3, Ho-Ping E. Rd., Taipei (TW)

( * ) Notice: Subject to any disclaimer, the term of this patent is extended or adjusted under 35 U.S.C. 154(b) by 0 days.

(21) Appl. No.: 09/899,114

(22) Filed: Jul. 6, 2001

(51) Int. Cl.[7] ..... B08B 3/02; B08B 3/14

(52) U.S. Cl. ..... 122/404; 122/396; 134/56 D; 134/58 D

(58) Field of Search ..... 122/396, 398, 122/404, 405; 134/25.2, 56 D, 57 D, 58 D

(56) References Cited

U.S. PATENT DOCUMENTS 3,575,157 A * 4/1971 Whittel, Jr. ..... 126/362
3,975,931 A * 8/1976 Bischkopf ..... 134/93
4,011,101 A * 3/1977 Levenback et al. ..... 134/56 D
4,439,242 A * 3/1984 Hadden ..... 134/25.2
4,457,323 A * 7/1984 Fay et al. ..... 134/25.2
5,385,168 A * 1/1995 Lund ..... 126/362

* cited by examiner

*Primary Examiner*—Gregory Wilson
(74) *Attorney, Agent, or Firm*—Rosenberg, Klein & Lee

(57) ABSTRACT

A flush line for dishwasher mainly includes a steam boiler provided at an upstream position of the flush line and having a water inlet connected to a water-in valve and a water outlet connected to a water stop valve; and a pump and a spray nozzle sequentially located downstream the water stop valve. When the water-in valve is opened, running water enters into the flush line to pass the steam boiler, at where the water is heated to produce a specific volume of steam that passes the pump and is pressurized before being sprayed via the nozzle to flush dishes in the dishwasher. High-temperature steam instantaneously evaporates 1i residual fat on the dishes and disinfects the same. Since steam contains less moisture, dishes washed with steam need not be dried with an electric heater.

1 Claim, 2 Drawing Sheets

FLUSH LINE FOR DISHWASHER

BACKGROUND OF THE INVENTION

The present invention relates to a flush line for dishwasher, and more particularly to a flush line for dishwasher that supplies high-temperature steam to thoroughly wash and disinfect dishes with reduced water and electric power.

FIG. 1 is a schematic perspective view of a conventional flush line for dishwasher. Flush water cycles along the flush line to wash dishes in the dishwasher. A pump 12 and an inlet valve 13 are connected to a water-in end of the circulating flush line, and a spray nozzle 14 is connected to a water-out end of the circulating flush line. When the inlet valve 13 is opened, water is supplied into the flush line and is pressurized at the pump 12 before flowing to the spray nozzle 14 and being sprayed to flush dishes in the dishwasher. The sprayed and used water is heated by an electric heating element 11 provided in the flush line and then, pumped into the flush line by the pump 12 for reuse. By controlling a switch for the electric heating element 11 in a selective manner, cold and hot water could be alternately sprayed to wash the dishes. The above-described flush line for dishwasher has the following disadvantages:

1. The flush water must be continuously cycled and heated to supply both cold and hot water, and therefore consumes a considerable amount of Water and electricity.

2. Detergent is added during the process of flushing to ensure the dishes are cleaned.

3. The flushed dishes contains a large amount of moisture and are usually dried with an electric heater that consumes power, too.

4. The flush water does not disinfect the dishes.

SUMMARY OF THE INVENTION

It is therefore a primary object of the present invention. to provide an improved flush line for dishwasher that is able to supply high-temperature (above 100° C.) steam that is capable of instantaneously evaporating residual fat and disinfecting the dishes to ensure good washing and cleaning effect. The use of detergent is saved and only reduced amount of water and electricity is required in a dishwasher having the flush line of the present invention, making the dishwasher an environment friendly product.

To achieve the above and other objects, the flush line for dishwasher of the present invention mainly includes a steam boiler provided at an upstream location of the flush line and having a water inlet connected to a water-in valve and a water outlet connected to a water stop valve; and a pump and a spray nozzle located downstream the water stop valve. When the water-in valve is opened, running water enters into the flush line to pass the steam boiler, at where the water is heated to produce a specific volume of hot water or steam that passes the pump and is pressurized before being sprayed via the nozzle to flush dishes in the dishwasher.

When the steam boiler is not turned on, cold water is supplied to the pump and sprayed from the nozzle. When the steam boiler is heated for a selected time period, hot water about 50 to 60° C. is supplied. It is possible to alternately supply steam and-cold water or hot water through control of the steam boiler.

The high-temperature steam has disinfecting ability and is environment-friendly because it instantaneously evaporates residual fat without the need of detergent. Moreover, since the high-temperature steam contains less moisture, dishes cleaned with steam need not be dried with an electric heater.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
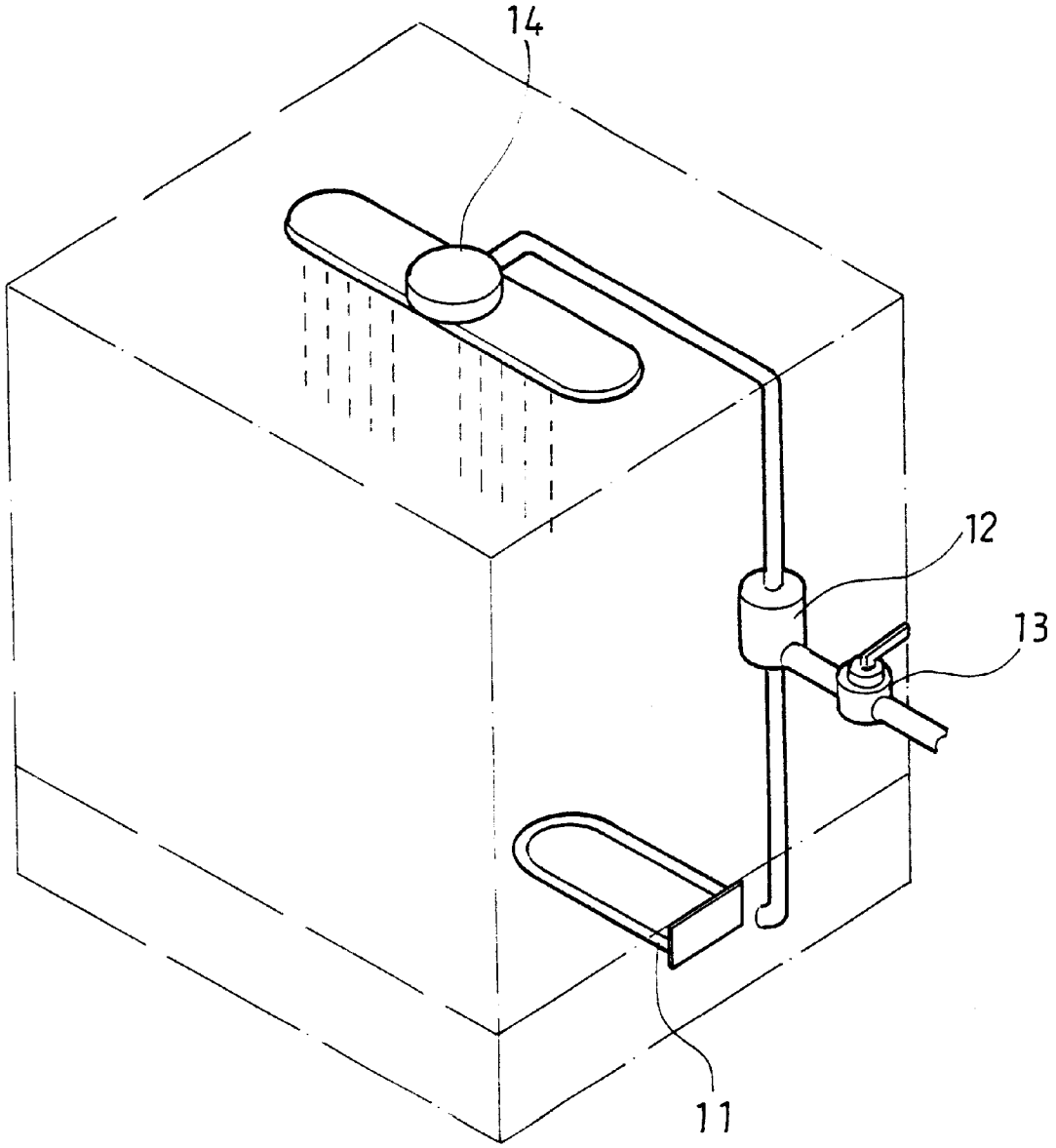
FIG. 1 PRIOR ART
FIG. 1 is a schematic view showing a conventional flush line for dishwasher.
Figure 2:
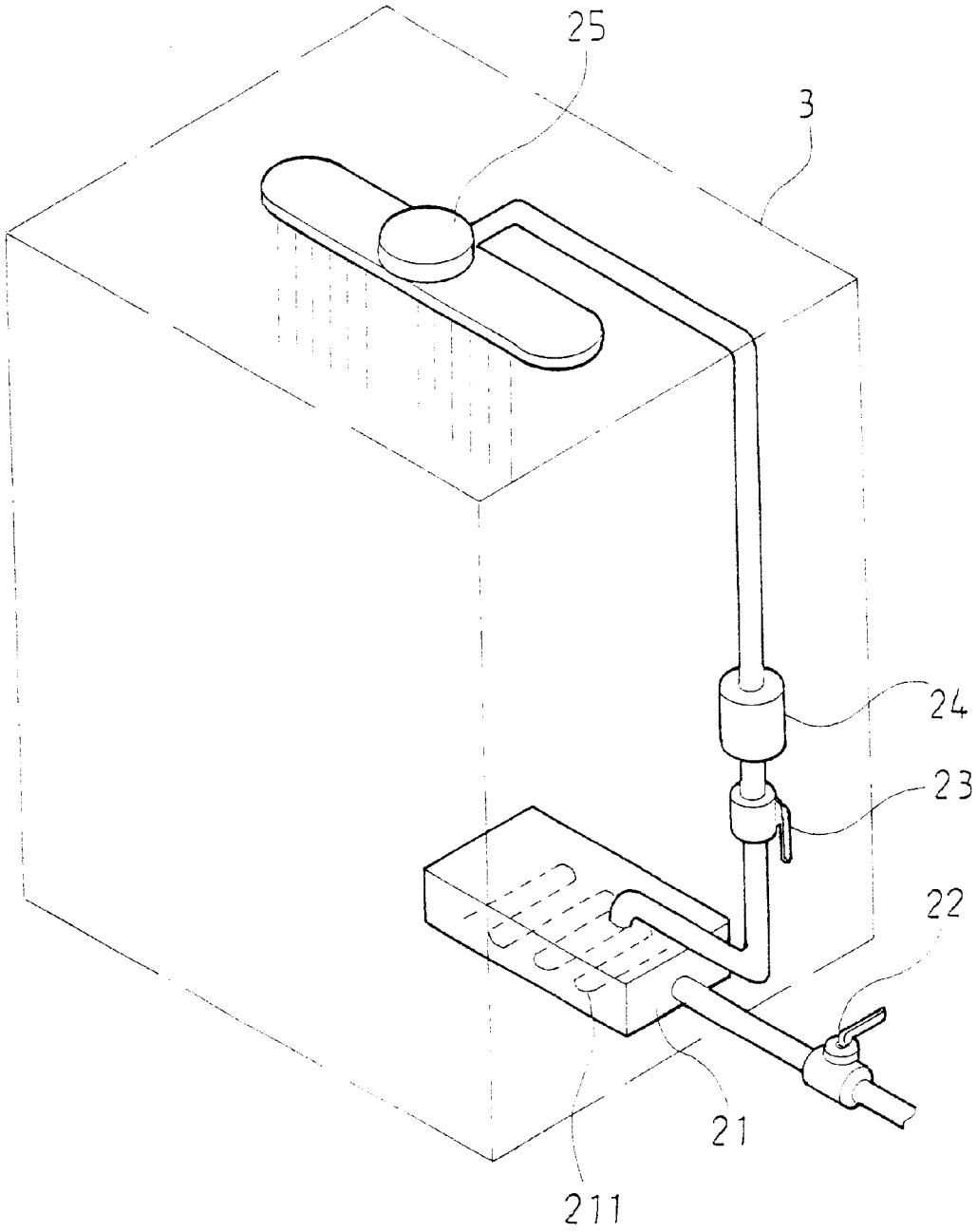
FIG. 2 is a schematic view showing a flush line for dishwasher according to the present invention.

Please refer to FIG. 2 that is a schematic perspective view showing a flush line for dishwasher according to the present invention. The flush line includes a steam boiler 21 mounted at a lower part of a dishwasher 3 to locate at an upstream point of the flush line. The steamboiler 21 is provided at a bottom with an electric heating element 211, and has a water inlet connected to a water-in valve 22, and a water outlet connected to a water stop valve 23. A pump 24 and a spray nozzle 25 are provided on the flush line downward the water stop valve 23.

When the water stop valve 23 is shutoff and the water-in valve 22 is opened, running water enters into the flush line to pass the steam boiler 21, at where the water is heated by the electric heating element 211 to produce a specific volume of steam in the steamboiler 21. When the water stop valve 23 is opened, the produced steam in the steam boiler 21 passes the pump 24 and is pressurized to spray from the nozzle 25, so that dishes in the dishwasher 3 are cleaned with high-temperature steam. When the electric heating element 211 is not heated or is heated for only a short time, cold or warm water is alternately supplied via the flush line to spray from the nozzle 25 for flushing dishes in the dishwasher 3.

With the flush line having the steam boiler 21 connected thereto, dishes in the dishwasher are purged with high-temperature steam or flushed with pressurized cold or warm water sprays and thoroughly cleaned.

The present invention has the following advantages over the conventional flush line for dishwasher:

1. The steam produced by the electric heating element in the steam boiler has a temperature higher than 100° C. that enables instantaneous evaporating of residual fat that is not easily washed away with cold or hot water.

2. The steam produced by the electric heating element in the steam boiler has a temperature higher than 100° C. that is sufficient to achieve a disinfectant effect.

3. Since the high-temperature steam evaporates residual fat, no detergent is needed in washing the dishes.

4. Since the steam contains less moisture (only contains about 5% to 6% of moisture), the wash cleaned dishes do not need further drying with an electric heater.

What is claimed is:

1. A flush line for dishwasher, comprising a steam boiler connected to a lower part of a dishwasher to locate at an upstream position in said flush line, said steam boiler having a water inlet connected to a water-in valve, and a water outlet connected to a water stop valve; and said flush line also comprising a pump and a spray nozzle sequentially located downstream said water stop valve; whereby when said water-in valve is opened, running water enters into said flush line to pass said steam boiler and is heated at said steam boiler to produce a specific volume of steam that passes said pump and is pressurized before being sprayed via said nozzle to flush dishes in said dishwasher.

* * * * *